US007866415B2

(12) United States Patent
Peters

(10) Patent No.: US 7,866,415 B2
(45) Date of Patent: Jan. 11, 2011

(54) STEERING DEVICE FOR DOWNHOLE TOOLS

(75) Inventor: Volker Peters, Wienhausen/Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 76 days.

(21) Appl. No.: 12/191,025

(22) Filed: Aug. 13, 2008

(65) Prior Publication Data

US 2009/0050370 A1 Feb. 26, 2009

Related U.S. Application Data

(60) Provisional application No. 60/957,917, filed on Aug. 24, 2007.

(51) Int. Cl.
*E21B 7/08* (2006.01)

(52) U.S. Cl. ..... 175/76; 175/61; 175/73

(58) Field of Classification Search ..... 175/61, 175/73, 76

See application file for complete search history.

(56) References Cited

U.S. PATENT DOCUMENTS 5,553,678 A * 9/1996 Barr et al. ..... 175/73
5,842,149 A 11/1998 Harrell et al.
6,233,524 B1 5/2001 Harrell et al.
6,913,095 B2 7/2005 Krueger
7,287,605 B2 10/2007 Van Steenwyk et al.
7,389,830 B2 6/2008 Turner et al.
7,413,034 B2 8/2008 Kirkhope et al.
2007/0215343 A1 9/2007 McDonald et al.
2007/0251726 A1 11/2007 Menger

OTHER PUBLICATIONS

Schlumberger (M. Williams, Sales Mgr., Drilling & Measurements), "RSS ready to open new worlds of drilling," Drilling Contractor, pp. 12-16, Mar./Apr. 2006.

* cited by examiner

*Primary Examiner*—Giovanna C Wright
(74) *Attorney, Agent, or Firm*—Cantor Colburn LLP

(57) ABSTRACT

An exemplary device carried on a rotating drill string includes an actuator that moves force application members and an associated controller. The force application members are actuated by an eccentricity between a force application members housing and the actuator. The controller synchronizes the extension of the force application members with the rotation of the drill string such that a steering force applied by the force application members is applied in the same azimuthal direction. The controller may also control magnitude of the steering force by adjusting the eccentricity. Another exemplary device maintains a wellbore device, such as a sensor, in a substantially non-rotating condition relative to a reference frame. The device includes a sensor conveyed by a rotating wellbore tubular, a drive configured to rotate the sensor; and a processor that controls the drive to maintain the sensor in a substantially non-rotating condition relative to the reference frame.

14 Claims, 5 Drawing Sheets

STEERING DEVICE FOR DOWNHOLE TOOLS

CROSS-REFERENCE TO RELATED APPLICATIONS

This application takes priority from U.S. Provisional Application Ser. No. 60/957,917 filed Aug. 24, 2007.

BACKGROUND OF THE DISCLOSURE

1. Field of the Disclosure

This disclosure relates generally to oilfield downhole tools and more particularly to drilling assemblies utilized for directionally drilling wellbores.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of the current drilling activity involves drilling of deviated and horizontal wellbores to more fully exploit hydrocarbon reservoirs. Such boreholes can have relatively complex well profiles. To drill such complex boreholes, some drilling assemblies utilize a plurality of independently operable force application members to apply force on the wellbore wall during drilling of the wellbore to maintain the drill bit along a prescribed path and to alter the drilling direction. For rotating drill stings, such force application members may be positioned on a non-rotating sleeve disposed around the rotating drive shaft. These force application members are moved radially to apply force on the wellbore in order to guide the drill bit and/or to change the drilling direction outward by electrical, mechanical, hydraulic or electro-hydraulic devices.

The present disclosure addresses the need for rotating steering devices that use force application members without using a non-rotating sleeve.

SUMMARY OF THE DISCLOSURE

In aspects, the present disclosure provides an apparatus for forming a wellbore in an earthen formation. In one embodiment, the apparatus may include a rotating drill string having one or more force application members that rotate with the rotating drill string. The force application members apply a steering force to a wellbore wall to steer the drill string in a selected direction. The apparatus also may include an actuator configured to extend and retract the force application member(s) and a controller operably connected to the actuator.

In embodiments, the actuator extends and retracts the force application members using a controlled eccentricity between a housing in which the force application members are disposed and the actuator. The actuator may include an inner cam positioned within an outer cam, each of which has an enlarged section. The eccentricity may be at a maximum when the enlarged sections are rotationally aligned and at a minimum when the enlarged sections are one-hundred eighty degrees out of rotational alignment. Thus, the actuator may control a magnitude of the steering force applied by the force application members by rotating the inner cam relative to the outer cam. In one arrangement, the inner and outer cams may be positioned in a ring that is connected to the force application members. The actuator may control an eccentricity between a housing axis and a ring axis to extend and retract the force application members.

In embodiments, the controller establishes the rotational orientation between the inner cam and the outer cam and synchronizes the extension and retraction of the force application members with the rotation of the drill string. The controller synchronizes the extension of the force application members with the rotation of the drill string such that the steering force applied by the force application members is directed to the same azimuthal direction. For example, the controller may cause the actuator to extend and retract the force application members once per revolution of the drill string. In one arrangement, the controller may include a first motor rotating the outer cam of the actuator and a second motor rotating the inner cam of the actuator. The second motor may rotate the inner cam relative to the outer cam to establish a desired relative rotational orientation, which controls the amount of extension of the force application members and thus the magnitude of the steering force. During operation, the controller may rotate the actuator, which includes both the inner cam and the outer cam, in a direction opposite to the direction of rotation of the drill string. This counter-rotation causes the eccentricity caused by the actuator to remain substantially stationary in relation to the earthen formation.

In aspects, the present disclosure provides a method for forming a wellbore in an earthen formation. The method may include rotating a drill string to form the wellbore; applying a steering force to a wellbore wall using one or more force application members positioned on the rotating drill string; moving the force application member(s) using an actuator; and controlling the actuator to synchronize the movement of the force application member(s) with the rotation of the drill string. In one arrangement, the actuator may include an inner cam positioned within an outer cam. The inner cam and the outer cam may each have enlarged sections. In aspects, the method may also include controlling a magnitude of the steering force applied by the force application member(s) by rotating the inner cam relative to the outer cam. Also, the method may include rotating the actuator to control an azimuthal direction for the steering force applied by the force application member(s).

In aspects, the present disclosure also provides an apparatus for maintaining a wellbore device, such as a sensor, in a substantially non-rotating condition relative to a reference frame. In embodiments, the substantially non-rotating condition may be relative to the earth's magnetic field, the earth's gravitational field, or other suitable reference frame. In embodiments, the apparatus may include a sensor conveyed into a wellbore by a rotating wellbore tubular; a drive configured to rotate the sensor; and a processor configured to control the drive to rotate the sensor to maintain the sensor in a substantially non-rotating condition relative to the reference frame. In certain embodiments, the sensor may be configured to make directional measurements. For example, the sensor may be a magnetometer or an inclinometer. Also, the sensor may be positioned inside the rotating wellbore tubular. In embodiments, the apparatus may also include a formation evaluation sensor measuring at least one formation parameter of interest that is correlated with the direction measurements. In embodiments, the apparatus may include a steering device for steering the wellbore tubular.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
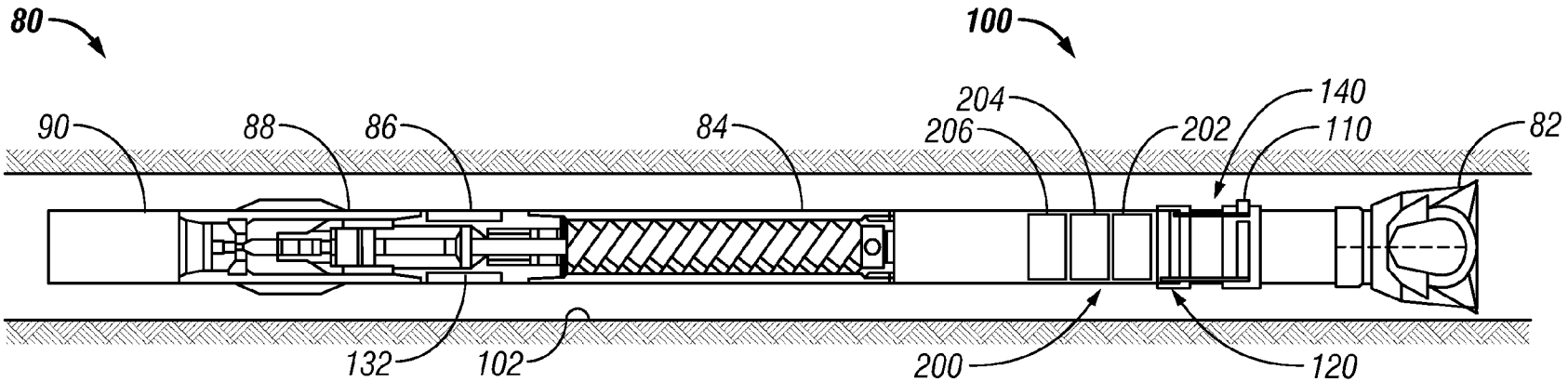
FIG. 1 illustrates an exemplary bottomhole assembly (BHA) made in accordance with one embodiment of the present disclosure.

The present disclosure relates to devices and methods for directional drilling of wellbores. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not necessarily be construed as essential.

As will be appreciated from the discussion below, aspects of the present invention provide a steering device that rotates with the drill string and/or BHA. The steering device applies a steering force to a wellbore wall to urge the drill bit in a selected drilling direction. To compensate for the rotation of the steering device, the steering device synchronizes the application of the steering force with the rotation of the drill string.

Referring now to FIG. 1, there is schematically illustrated one embodiment of a BHA 80 that uses a steering unit 100 that incorporates aspects of the present teachings. In one configuration, the BHA 80 includes a drill bit 82, a drilling motor 84, a sensor sub 86, a bidirectional communication and power module (BCPM) 88, and a formation evaluation (FE) sub 90. To enable power and/or data transfer to the other making up the BHA 80, the BHA 80 includes a power and/or data transmission line (not shown). The steering device 100 rotates with the BHA 80 and may be operated to steer the BHA 80 along a selected drilling direction by applying an appropriate steering force vector to a wellbore wall 102.

The steering device 100 may include a plurality of force application members 110 that apply a steering force to the wellbore wall 102, an actuator 120 that controls the movement of the force application members 110 using a drive 140, and a control unit 200 that controls the actuator 120 in a manner that applies a steering force in a desired direction and magnitude. The control unit 200 may receive signals/power from equipment positioned along the drill string 22 (FIG. 5), such as from the sensor sub 86 and BCPM 88.

Figure 2:
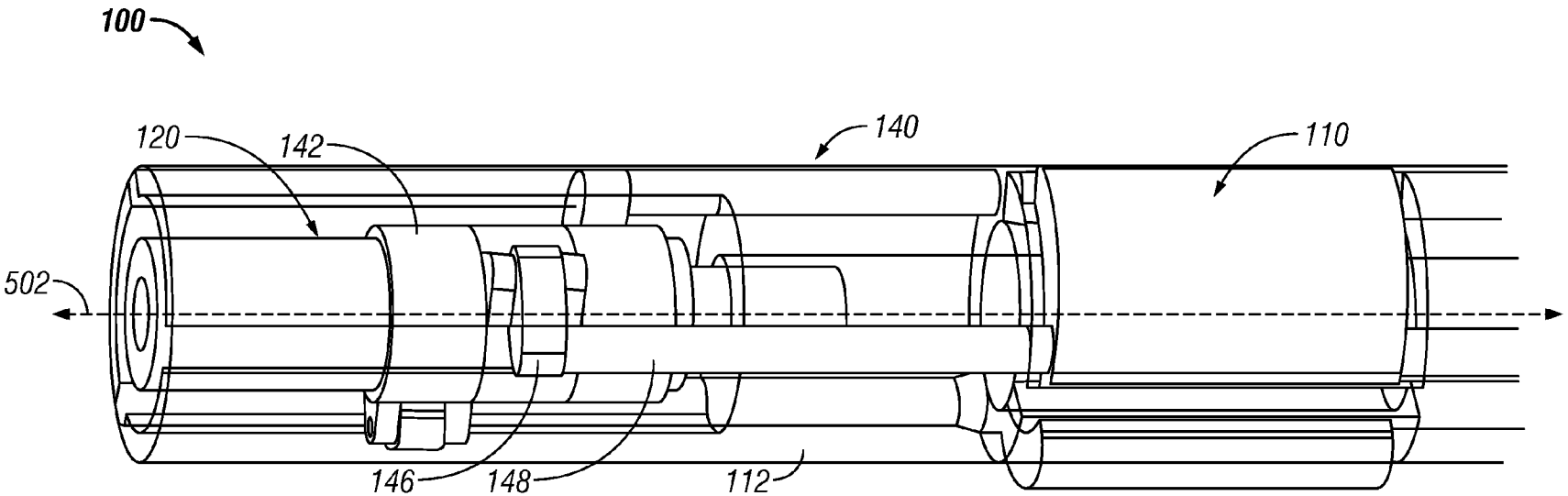
FIG. 2 isometrically illustrates elements of a steering device made in accordance with one embodiment of the present disclosure.
Figure 3:
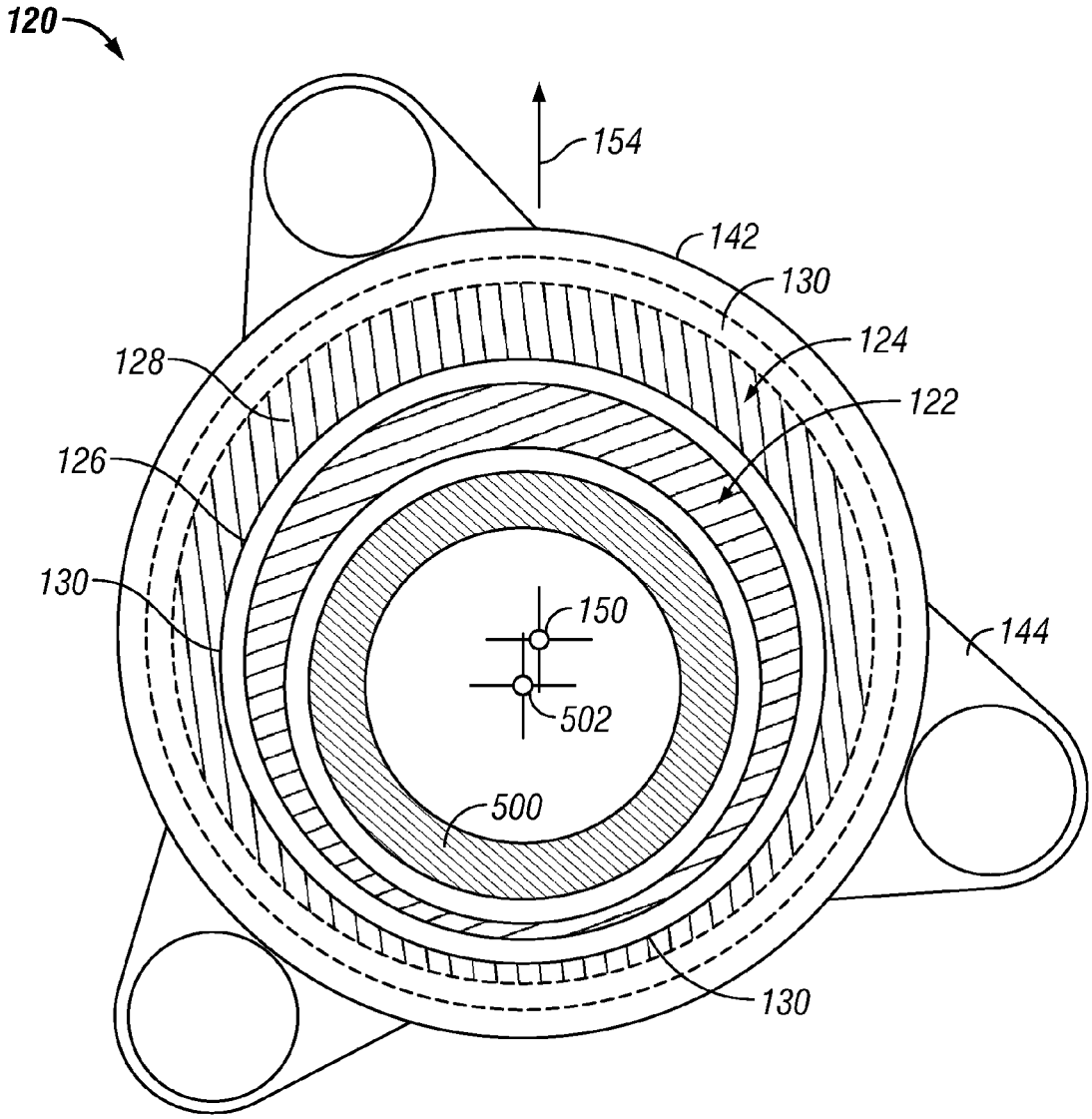
FIG. 3 schematically illustrates a sectional view of a portion of a steering device made in accordance with one embodiment of the present disclosure.

Referring now to FIGS. 2 and 3, there is shown one embodiment of a steering device 100 for controlling a drilling direction of the BHA 80 (FIG. 1). In one embodiment, the steering device includes a plurality of force application members 110 that apply a steering force to a wellbore wall and an actuator 120 that controls the movement of the force application members. A drive 140 transfers a motion of the actuator 120 to the force application members 110. The steering device 100 is positioned in a housing 112. The housing 112 and the force application members 110 rotate with the BHA 80 (FIG. 1). As will be described in greater detail below, the actuator 120 controls the extension and retraction of the force application members 110 in a manner such that the force application members 110 apply a steering force in substantially one azimuthal direction, which then steers the drill bit in a selected direction.

In one arrangement, the force application member 110 may be formed as ribs that pivot or rotate into engagement with the wellbore wall 102 (FIG. 1) to generate the steering force. In other embodiments, the force application member 110 may be formed as a piston or pad that extends or retracts in a radial direction. While three force application members 110 are shown, it should be understood that fewer or greater force application members 110 may be used. The force application members 110 may be positioned in the housing 112.

The actuator 120 and the drive 140 cooperate to control the movement of the force application members 110 to control the direction of the steering force applied to the wellbore wall and, in some embodiments, the magnitude of that steering force. As best seen in FIG. 3, in one arrangement, the actuator 120 includes an inner cam element 122 positioned within an outer cam element 124. The inner cam element 122 can rotate relative to the outer cam element 124. Referring now to FIGS. 2 and 3, the drive 140 includes one or more serially positioned rings 142 that are connected at ears 144 to a lever 146. Each lever 146 is connected to a force application member 110 by a connector 148. The connectors 148 may be configured as torsional springs to allow the force application members to accommodate irregular surfaces encountered on the wellbore wall 102 (FIG. 1). That is, even when extended radially outward, the force application members 110 may momentarily deflect radially inward to reduce contact pressure with the wellbore wall 102 and reduce the likelihood of damage to the steering device 100.

The cam elements 122 and 124 are positioned within the rings 142. The cam elements 122 and 124 may be formed as generally tubular members, each of which has an enlarged section, 126 and 128, respectively. The cam elements 122 and 124 surround the mandrel 500. The mandrel 500 may be any support member through which drilling fluid flows to the drill bit 82 (FIG. 1) and connects the drill bit 82 (FIG. 1) to the BHA components uphole of the steering unit 100. Friction reducing elements 130, such as needle bearings, may be positioned between each of the rotating elements to reduce friction between the otherwise mating surface of these rotating elements.

The enlarged sections, 126 and 128, are sized to cause an adjustable eccentricity between a center of rotation 150 of the rings 142 and a tool axis 502 of a mandrel 500. Because of the fixed relationship between the BHA 80 and the housing 112 of the force application members 110, a corresponding eccentricity is caused between the center of rotation 150 of the rings 142 and the longitudinal axis of the housing 112, which is substantially the same axis as the tool axis 502. It is this eccentricity that causes the extension and retraction of the force application members 110. In the embodiment shown, a maximum eccentricity is formed between the rings 142 and the mandrel 500 when the enlarged sections 126 and 128 are aligned. Substantially no eccentricity is formed between the rings 142 and the mandrel 500 when the enlarged sections 126 and 128 are positioned 180 degrees apart from one another, if, like displayed in FIGS. 3 and 4, the enlarged sections of cam 122 and 124 are sized equally. If the enlarged section of cam 122 is different from the one of cam 124 the resulting eccentricity varies between a minimum and a maximum. In order to drill a straight well path, a method analogous to one described further below may be utilized.

Figure 4A:
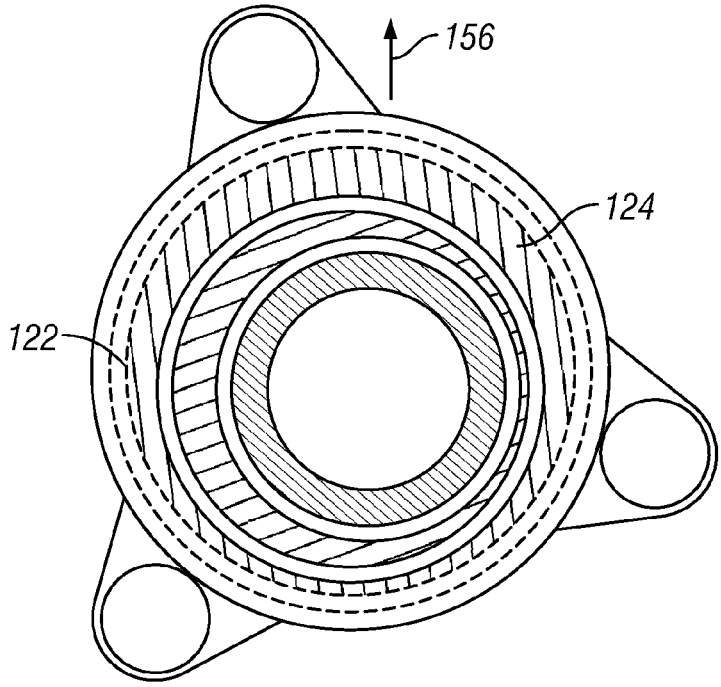
FIGS. 4A & 4B schematically illustrate different positions of cam elements for a steering device made in accordance with one embodiment of the present disclosure.
Figure 4B:
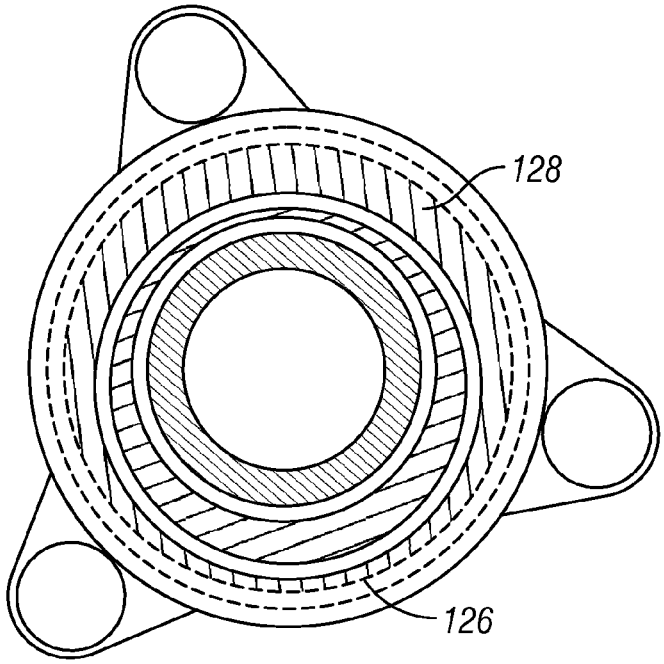

The azimuthal direction of the eccentricity controls the azimuthal direction along which the steering force is applied to the wellbore wall. The magnitude of the eccentricity controls the amount of steering force applied to the wellbore wall. In FIG. 3, the inner cam 122 and the outer cam 124 have been rotated relative to one another to cause alignment between the enlarged sections 126 and 128. The eccentricity produced by the enlarged sections 126 and 128 causes a maximum steering force 154 to be applied in an "upward" direction, which may be described as a zero degree azimuthal direction. In FIG. 4A, the inner cam 122 and the outer cam 124 have been rotated relative to one another to cause a ninety degree misalignment. The resulting eccentricity causes an intermediate steering force 156 to be applied in the "upward" direction. In FIG. 4B, no steering force is applied because the enlarged sections 126 and 128 are positioned 180 degrees apart. The azimuthal direction of the steering force, e.g., forces 134 and 136, may be changed by rotating both the inner cam 122 and outer cam 124. That is, after the inner cam 122 and the outer cam 124 have a selected angular relationship, the inner cam 122 and the outer cam 124 are rotated in a manner that maintains the selected angular relationship.

Referring now to FIG. 1, as noted above, the steering device 100 rotates with the BHA 80. In order for the force application members 110 to apply the steering force in the generally same azimuthal direction during rotation of the BHA 80, the actuator 120 is maintained in a substantially stationary relationship relative to the wellbore wall by the control unit 200. In one embodiment, the control unit 200 rotates the actuator 120 in a direction opposite to the rotation of the BHA 80 and at rotational speed that is the same as the BHA 80 rotation speed. Thus, the eccentricity of the center of the rings 146 with respect to the tool axis 502 would be substantially stationary relative to the wellbore wall.

In embodiments, the control unit 200 may include an electric motor 202 connected to the actuator 120 via a suitable drive elements such as a flex shaft or tubular element. The control unit 200 may also include a controller 206 that receives inputs such as sensor signals and command signals and operates the motor 202 at a speed needed to obtain the desired position and orientation of the actuator 120. In one arrangement, the motor 202 may be configured to rotate the actuator 120, which includes the cam elements 122 and 124, and also rotate the inner cam element 122 relative to the outer cam element 124. A clutch mechanism (not shown) may be used to selectively rotate either or both of the cam elements 122 and 124 using the motor 202. In another embodiment, a second motor drive 204 may be used to rotate the inner cam element 122 relative to the outer cam element 124, which as noted previously controls the eccentricity of the center of the rings 142 relative to the tool axis. The second motor drive 204 may be rotated together with the first drive in order to be operated within a limited angular movement of only 180°.

The relative position and orientation of the elements forming the steering unit 100 and adjacent components may be determined from the sensors positioned along the BHA 80, such as in the sensor sub 86. Exemplary sensors for determining position or orientation parameters include rotational speed sensors (RPM), azimuth sensors, inclination sensors, gyroscopic sensors, magnetometers, three-axis accelerometers. Additional position or orientation information may be obtained from the motors 202 and 204. For example, the relative angular stator and rotor positions of the motors 202 and 204 may be determined to thereby determine the angular positions of the elements to which they are connected, such as the actuator 120 and the inner cam element 122.

Figure 5:
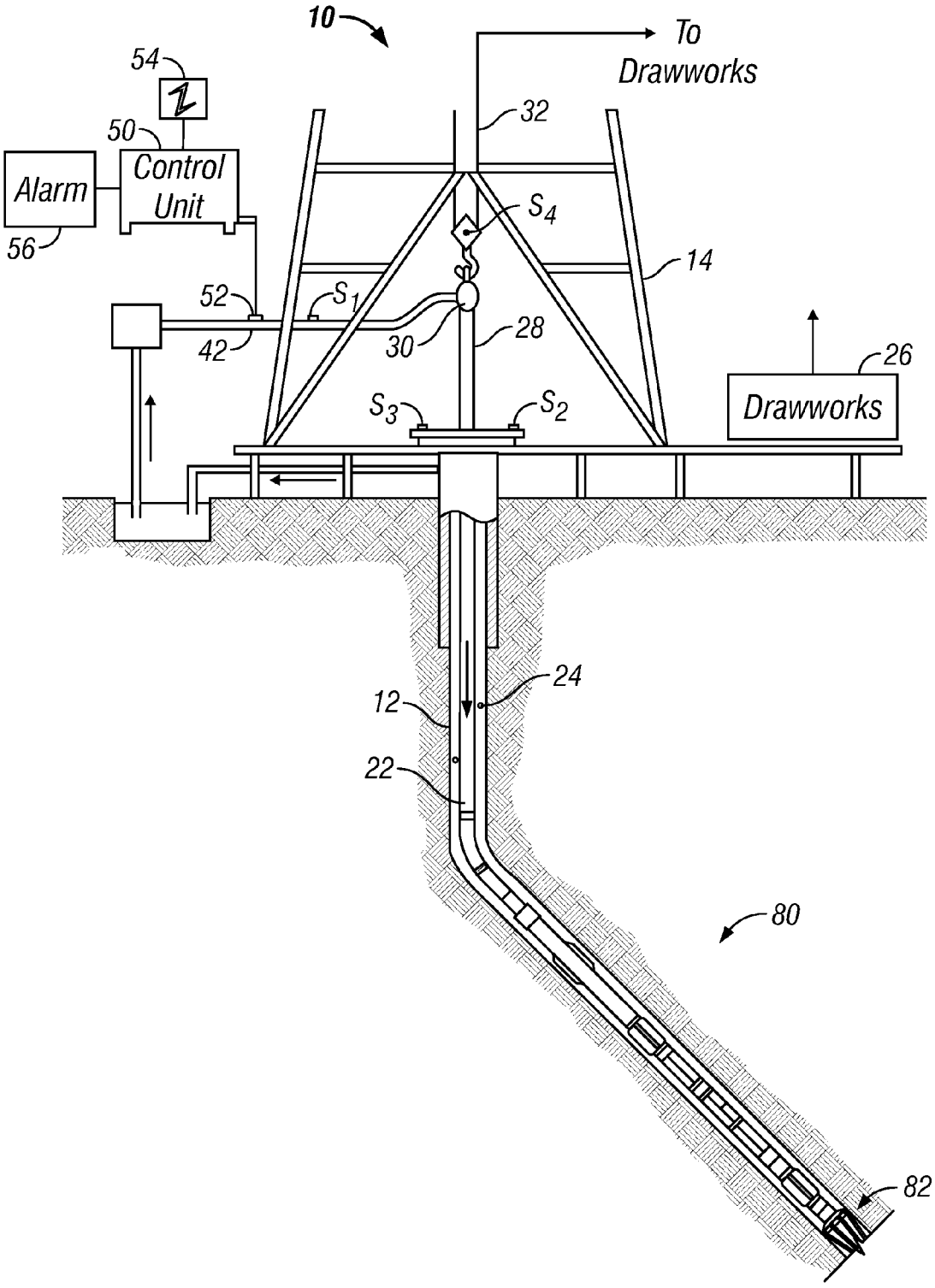
FIG. 5 illustrates a drilling system made in accordance with one embodiment of the present disclosure.

Referring now to FIG. 5, there is shown an embodiment of a drilling system 10 utilizing a steerable drilling assembly or bottomhole assembly (BHA) 80 made according to one embodiment of the present disclosure to directionally drill wellbores. While a land-based rig is shown, these concepts and the methods are equally applicable to offshore drilling systems. The system 10 shown in FIG. 5 has a drilling assembly 80 conveyed in a borehole 12. The drill string 22 includes a jointed tubular string 24, which may be drill pipe or coiled tubing, extending downward from a rig 14 into the borehole 12. The drill bit 82, attached to the drill string end, disintegrates the geological formations when it is rotated to drill the borehole 12. The drill string 22, which may be jointed tubulars or coiled tubing, may include power and/or data conductors such as wires for providing bidirectional communication and power transmission. The drill string 22 is coupled to a drawworks 26 via a kelly joint 28, swivel 30 and line 32 through a pulley (not shown). The operation of the drawworks 26 is well known in the art and is thus not described in detail herein.

A surface controller 50 receives signals from the downhole sensors and devices via a sensor 52 placed in the fluid line 42 and signals from sensors $S_1$, $S_2$, $S_3$, hook load sensor $S_4$ and any other sensors used in the system and processes such signals according to programmed instructions provided to the surface controller 50. The surface controller 50 displays desired drilling parameters and other information on a display/monitor 54 and is utilized by an operator to control the drilling operations. The surface controller 50 contains a computer, memory for storing data, recorder for recording data and other peripherals. The surface controller 50 processes data according to programmed instructions and responds to user commands entered through a suitable device, such as a keyboard or a touch screen. The controller 50 is preferably adapted to activate alarms 56 when certain unsafe or undesirable operating conditions occur.

Referring now to FIGS. 1 and 5, the sensor sub 86 may includes sensors for measuring near-bit direction (e.g., BHA azimuth and inclination, BHA coordinates, etc.), dual rotary azimuthal gamma ray, bore and annular pressure (flow-on & flow-off), temperature, vibration/dynamics, multiple propagation resistivity, and sensors and tools for making rotary directional surveys. The formation evaluation sub 90 may includes sensors for determining parameters of interest relating to the formation, borehole, geophysical characteristics, borehole fluids and boundary conditions. These sensor include formation evaluation sensors (e.g., resistivity, dielectric constant, water saturation, porosity, density and permeability), sensors for measuring borehole parameters (e.g., borehole size, borehole roughness. true vertical depth, measured depth), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid.

The subs 86 and 90 may include one or memory modules and a battery pack module to store and provide back-up electric power may be placed at any suitable location in the BHA 80. Additional modules and sensors may be provided depending upon the specific drilling requirements. Such exemplary sensors may include an rpm sensor, a weight on bit sensor, sensors for measuring mud motor parameters (e.g., mud motor stator temperature, differential pressure across a mud motor, and fluid flow rate through a mud motor), and sensors for measuring vibration, whirl, radial displacement, stick-slip, torque, shock, vibration, strain, stress, bending moment, bit bounce, axial thrust, friction and radial thrust. The near bit inclination devices may include three (3) axis accelerometers, gyroscopic devices and signal processing circuitry as generally known in the art. These sensors may be positioned in the subs 86 and 90, distributed along the drill pipe, in the drill bit and along the BHA 80. Further, while subs 86 and 90 are described as separate modules, in certain embodiments, the sensors above described may be consolidated into a single sub or separated into three or more subs. The term "sub" refers merely to any supporting housing or structure and is not intended to mean a particular tool or configuration.

A processor 132 processes the data collected by the sensor sub 86 and formation evaluation sub 90 and transmit appropriate control signals to the steering device 100. The processor 132 may be configured to decimate data, digitize data, and include suitable PLC's. For example, the processor may include one or more microprocessors that uses a computer program implemented on a suitable machine readable medium that enables the processor to perform the control and processing. The machine readable medium may include ROMs, EPROMs, EAROMs, Flash Memories and Optical disks. Other equipment such as power and data buses, power supplies, and the like will be apparent to one skilled in the art. While the processor 132 is shown in the sensor sub 86, the processor 132 may be positioned elsewhere in the BHA 80. Moreover, other electronics, such as electronics that drive or operate actuators for valves and other devices may also be positioned along the BHA 80.

The bidirectional data communication and power module ("BCPM") 88 transmits control signals between the BHA 80 and the surface as well as supplies electrical power to the BHA 80. For example, the BCPM 88 provides electrical power to the steering device 100 and establishes two-way data communication between the processor 132 and surface devices such as the controller 50. In one embodiment, the BCPM 88 generates power using a mud-driven alternator (not shown) and the data signals are generated by a mud pulser (not shown). The mud-driven power generation units (mud pursers) are known in the art thus not described in greater detail. In addition to mud pulse telemetry, other suitable two-way communication links may use hard wires (e.g., electrical conductors, fiber optics), acoustic signals, EM or RF. Of course, if the drill string 22 includes data and/or power conductors (not shown), then power to the BHA 80 may be transmitted from the surface.

Referring now to FIGS. 1 and 5, in an exemplary manner of use, the BHA 80 is conveyed into the wellbore 12 from the rig 14. During drilling of the wellbore 12, the steering device 100 steers the drill bit 82 in a selected direction. The drilling direction may follow a preset trajectory that is programmed into a surface and/or downhole controller (e.g., controller 50 and/or controller 132). The controller(s) use directional data received from downhole directional sensors to determine the orientation of the BHA 80, compute course correction instructions if needed, and transmit those instructions to the steering device 100. During drilling, the radial position (e.g., extended or retracted) of the cutting elements 210 is displayed on the display 54.

An exemplary mode of operation of the steering unit 100 will now be described. As an arbitrary starting point, the drill string 22 may be drilling the wellbore without curvature, e.g., drilling a straight wellbore. In such a condition, the motor 204 is operated to bring the enlarged portion 126 into a one hundred eighty degree angular position away from the enlarged portion 128. With this relative alignment of the inner and outer cams 122 and 124, the center of the rings is generally aligned or concentric with the tool axis 502. Thus, because all of the components of the steering unit 100 are generally aligned, the ribs 100 remain in a dormant or retracted condition.

If the tools processor and sensor measure a deviation from the straight wellbore direction, the enlarged position 126 is brought to a position different from 180 degree with respect to the enlarged position of 128. The amount of angular offset is determined by the amount of deviation from the predefined wellbore profile (straight). The enlarged position 128 is brought to a azimuthal direction opposite to the wellbore deviation to account for the misalignment to the predefined wellbore direction.

To initiate directional drilling, a drilling direction is first selected. The drilling direction may be selected by a downhole controller and/or by personnel at the surface. Thereafter, a downhole controller and/or personnel at the surface may determine the azimuthal direction of the steering force and the amount of steering force required to steer the drill string 22 in the selected direction. Thereafter, one or more controllers may determine the momentary rotational speed (RPM) of the steering unit 100. This rotational speed may be the drill string 22 rotational speed (RPM) or the BHA 80 rotational speed (RPM). The controllers may also determine the angular positions of the inner and outer cams 122 and 124 with respect to the earth formation utilizing a rotational azimuth sensor such as a rotating magnetometer or a rotating accelerometer. Once the relative angular positions have been determined, the control unit 200 may operate the motor 204 to cause the angular alignment between the enlarged sections 126 and 128 that corresponds to the desired amount of steering force (e.g., maximum steering force, three-quarters steering force, one-third steering force, etc.). Next, the control unit 200 counter-rotates the actuator 120 relative to the drill string 22 at a rotational speed that matches the rotation of the drill string 22. Thereafter, the control unit 200 superimposes an angular rotation of the combined inner and outer cams 122 and 124 to direct the steering force to the necessary azimuthal direction.

Coupling a gravity (accelerometer) or azimuth (magnetometer) sensor to the components that do not rotate relative to the wellbore enables the determination of magnetic and gravity direction within the steering tool. Also, a processor may be utilized to control the drive mechanism together with the coupled sensor package to create the counter rotating movement of the drive mechanism. When gravity and azimuth readings get steady, a rotational speed matching the rotation of the drill string is achieved. A pick up sensor or resolver may then be used to get the positional information of the combined inner and outer cams 122 and 124 to adjust the steering direction towards the desired azimuth and inclination.

It should be appreciated that the actuator 120 during the counter-rotation causes the eccentricity of the centers 150 of the rings 142 relative to the tool axis 502 to remain effectively stationary relative to the wellbore wall. As the rings 142 rotate with the BHA 80, the levers 146 connected to each ring 142 in succession slide over the enlarged portions 126 and 128. The eccentricity causes by the enlarged portions 126 and 128 causes each lever 146 to rock or rotate a small amount. The connectors 148 connected to each lever 146 translate the rotation of the lever 146 to the force application member 110, which rotate or extend outward a corresponding amount. Thus, each force application member 110 extends out to apply a steering force to the wellbore wall once every revolution of the BHA 80. Moreover, the control unit 200 synchronizes the application of the steering force such that the steering force is applied in the same azimuthal direction. In response to the applied steering force, the drill string moves in the desired direction. It should be appreciated that the configuration shown in FIG. 2 reduces, if not eliminates, the need for dynamic seals. It is known in the industry that dynamic seals may be prone to excessive wear and failure and, therefore, are avoided where possible. Because the components in contact with the drilling fluid are rotating with the drill string, dynamic seals may not be necessary. The only movement fed through the tool housing 112 is the relatively small angular movement of the lever 146 and connector 148. This small angular movement may be hermetically sealed by flexible elements (not shown) such as rubber elements, flexible metal bellows or other suitable devices).

The relative alignment or position of the steering unit 100 and related components may be periodically or continually monitored by the control unit 200 or other downhole processors. The control unit 200 or other downhole processors may adjust the steering unit 100 to account for any variations or discrepancies that may arise to thereby maintain the desired drilling direction. Moreover, if the amount of steering force needs to be increased or decreased, the control unit 200 may operate the motor 204 to cause the desired alignment orientation between the enlarged portions 126 and 128. Similarly, if the direction of drilling requires change, the control unit 200 may adjust operation of the motor 202 until the actuator is pointed in the desired azimuthal direction or inclination.

Therefore, it should be appreciated that what has been described includes, in part, an apparatus that includes a rotating drill string having one or more force application members that rotate with the drill string. The force application members may apply a steering force to a wellbore wall to steer the drill string in a selected direction. The apparatus also may include an actuator configured to extend and retract the force application members and a controller operably connected to the actuator. One non-limiting embodiment of an actuator moves, e.g., extends and retracts, the force application members using a controlled eccentricity between a housing in which the force application members are disposed and the actuator. The actuator may control a magnitude of the steering force applied by the force application members by rotating the inner cam relative to the outer cam. In one non-limiting arrangement, the controller establishes the rotational orientation between the inner cam and the outer cam and synchronizes the extension and retraction of the force application members with the rotation of the drill string.

It should be appreciated that what has been described also includes, in part, a method for forming a wellbore in an earthen formation. The method may include rotating a drill string to form the wellbore; applying a steering force to a wellbore wall using one or more force application members positioned on the rotating drill string; moving the force application member(s) using an actuator; and controlling the actuator to synchronize the movement of the force application member(s) with the rotation of the drill string.

It should be appreciated that what has been described further includes, in part, an apparatus for maintaining a wellbore device, such as a sensor, in a substantially non-rotating condition relative to a reference frame. In embodiments, the substantially non-rotating condition may be relative to the earth's magnetic field, the earth's gravitational field, or other suitable reference frame.

As will be appreciated by one skilled in the art, the present disclosure is amenable to numerous adaptations. For example, while electric motors have been described as driving the operating force for the steering unit 100, a hydraulic motor with may also be utilized. Additionally, in certain embodiments, a single cam may be used to generate a steering force. For instance, a preset eccentricity may be used to steer the drill bit in a particular direction. For straight drilling, the preset eccentricity may be rotated with a rotary speed different from the drill string rotation (e.g., slowly) such that the applied steering force is circumferentially distributed, which would cause a generally straight drilling.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

The invention claimed is:

1. An apparatus for forming a wellbore in an earthen formation, comprising:

a drill string configured to form the wellbore;

a force application member positioned on the drill string, the force application member being configured to apply a steering force to a wellbore wall;

an actuator configured to extend and retract the force application member, the actuator including a first cam positioned within a second cam; and a controller configured to control the actuator to synchronize the extending and retracting with a rotation of the drill string.

2. The apparatus according to claim 1, wherein the actuator extends and retracts the force application member once per revolution of the drill string.

3. The apparatus according to claim 1, wherein the first cam and the second cam each having enlarged sections.

4. The apparatus according to claim 3, wherein the actuator is configured to control a magnitude of the steering force applied by the force application member by rotating the first cam relative to the second cam.

5. The apparatus according to claim 3, further comprising a ring in which the first cam and the second cam are positioned, the ring being connected to the force application member.

6. The apparatus according to claim 5, further comprising a housing in which the force application member is positioned, the housing having a first axis, and wherein the ring has a second axis, and wherein the actuator is configured to control an eccentricity between the first axis and the second axis to extend and retract the force application member.

7. The apparatus according to claim 3, wherein the controller includes a motor rotating the second cam.

8. The apparatus according to claim 3, wherein (i) the actuator extends and retracts the force application member once per revolution of the drill string, (ii) the controller rotates the actuator in a direction opposite to the direction of rotation of the drill string.

9. The apparatus according to claim 1, wherein the controller is configured to rotate the actuator to control one of (i) an azimuthal direction and (ii) an inclination for the steering force applied by the force application member.

10. The apparatus according to claim 1, wherein the controller includes a motor rotating the first cam.

11. A method for forming a wellbore in an earthen formation, comprising:

rotating a drill string to form the wellbore;

applying a steering force to a wellbore wall using a force application member positioned on the drill string;

moving the force application member using an actuator; and controlling the actuator to synchronize the movement of the force application member with the rotation of the drill string, wherein the actuator includes a first cam positioned within a second cam.

12. The method according to claim 11, wherein, the first cam and the second cam each having enlarged sections.

13. The method according to claim 12, further comprising controlling a magnitude of the steering force applied by the force application member by rotating the first cam relative to the second cam.

14. The method according to claim 12, further comprising rotating the actuator to control an azimuthal direction for the steering force applied by the force application member.

* * * * *